United States Patent [19]

Matthews

[11] 4,111,639

[45] Sep. 5, 1978

[54] PROVEN PILOT FUEL IGNITION SYSTEM WITH SAMPLING FLAME SENSOR

[75] Inventor: Russell Byron Matthews, Goshen, Ind.

[73] Assignee: Johnson Controls, Inc., Milwaukee, Wis.

[21] Appl. No.: 772,079

[22] Filed: Feb. 25, 1977

[51] Int. Cl.[2] ..... F23N 5/12

[52] U.S. Cl. ..... 431/25; 431/26; 431/46; 431/66; 431/73

[58] Field of Search ..... 431/24–27, 431/43, 46, 66, 73, 74

[56] References Cited

U.S. PATENT DOCUMENTS

| | | | |
|---|---|---|---|
| 3,902,839 | 9/1975 | Matthews | 431/25 |
| 3,914,092 | 10/1975 | Matthews | 431/66 |
| 3,918,881 | 11/1975 | Matthews | 431/46 |
| 3,947,220 | 3/1976 | Dietz | 431/27 |
| 3,955,910 | 5/1976 | Matthews | 431/25 |
| 4,038,019 | 7/1977 | Matthews | 431/66 |

*Primary Examiner*—Carroll B. Dority, Jr.
*Attorney, Agent, or Firm*—Emrich, Root, O'Keeffe & Lee

[57] ABSTRACT

A self-checking fuel ignition system of the pilot ignition type including a sampling flame sensor which effects periodic testing of the operability of a spark generating circuit to provide ignition sparks, and an energizing circuit which operates independently of the spark generating circuit but under the control of the flame sensor, to control the operation of fuel valves of the system and to effect the shut down of the system for loss of flame or ignition spark.

18 Claims, 2 Drawing Figures

PROVEN PILOT FUEL IGNITION SYSTEM WITH SAMPLING FLAME SENSOR

BACKGROUND OF THE INVENTION

1. Field of the Invention

This invention relates to fuel ignition systems, and more particularly to a self-checking, dual channel fuel ignition system providing automatic shut off of fuel in the event of loss of flame or ignition sparks.

2. Description of the Prior Art

Fuel ignition systems generally include an igniter circuit having a pulse generator operable when enabled to generate high voltage pulses which are applied to a pair of ignition electrodes positioned adjacent to a fuel outlet. The electrodes are spaced apart to provide a gap therebetween such that the high voltage pulses applied to the electrodes produce ignition sparks for igniting fuel emanating from the outlet to establish a flame. When a flame is established, a flame sensing circuit disables the pulse generator. In the event of a flame out, the flame sensing circuit reenables the pulse generator to attempt reignition of the fuel.

In certain igniter circuits, a pulsating control device is employed for disabling the pulse generator whenever a flame is established. In ignition systems energized from an AC voltage source, the cyclical AC voltage can be used to drive such control device. However, in ignition systems energized from a DC source, such as may be used in a heating system for a mobile recreational vehicle, an inverter circuit is needed to provide the required pulsating drive resulting in additional cost to the system.

A further consideration is that in the event of a flame out condition, reignition of the fuel depends on the operability of the spark generator of the igniter circuit. Thus, in the event of a malfunction of the spark generator, unburned gas will be wasted as the igniter circuit cycles to attempt reignition. Moreover, since the igniter circuit usually is located in an enclosure and is generally not readily accessible to view, failure of the spark generator may go unnoticed for a long time.

In my U.S. Pat. No. 3,914,092, which was issued on Oct. 21, 1975, there is disclosed a direct spark ignition system employing a sampling spark sensor. The system includes an ignition circuit for generating sparks for igniting fuel discharged by a fuel outlet, an energizing circuit controlled by the ignition circuit to operate fuel valves to supply fuel to the fuel outlet, and a flame sensing circuit operable when a flame is established to normally disable the ignition circuit and to periodically enable the ignition circuit to test the operability of the ignition circuit and to test for the presence of a flame.

The system automatically tests the operability of the ignition circuit and provides automatic shut off of the fuel supply in the event of loss of flame or loss of ignition sparks. The system also provides remote indication of loss of spark or flame.

SUMMARY OF THE INVENTION

The present invention has provided a self-checking fuel ignition system including a sampling flame sensor which enables periodic testing of the operability of a spark generating means of the system. The system includes an energizing means which operates independently of the spark generating means, but under the control of a spark and flame sensing means of the system, to control the operation of fuel valve means of the system.

When the system is activated, as by the closing of thermostatically controlled contacts, the energizing means is enabled to control the valve means to supply fuel to a burner apparatus, and the spark generating means is enabled to generate sparks for igniting the fuel. When the fuel is ignited, the flame sensing means disables the spark generating means and controls the energizing means to maintain the valve means in fuel supplying condition.

The flame sensing means is operable when a flame is established to cause the system to be operable in a sampling mode in which the spark generating means is disabled during a first period of time and enabled to generate sparks during a second period of time. The energizing means responds to the flame sensing means to cause the valve means to interrupt the supply of fuel to the burner apparatus if the spark generating means fails to provide sparks during the second period of time or if the flame becomes extinguished. The system may include an indicator means which provides a remote indication of loss of flame or spark.

In accordance with a disclosed embodiment, the system is of the proven-pilot type and includes a pilot valve and a main valve which comprise a redundant valve assembly. The pilot valve supplies fuel to a pilot outlet of the burner apparatus for ignition to provide a pilot flame. The pilot valve also supplies fuel to an inlet of the main valve. The main valve supplies fuel to the burner apparatus for ignition by the pilot flame. The energizing means includes control means having first switching means operable when the system is activated to operate the pilot valve, and a second switching means enabled when a pilot flame is established to operate the main valve. The control means includes an interlock arrangement wherein the first switching means is operated following activation of the system only if the second switching means is disabled at such time. Thus, if for any reason the second switching means is enabled at the time the system is activated, the first switching means cannot operate, and the pilot valve of the redundant valve assembly is maintained deenergized, providing 100% shut off of fuel to the system.

The energizing means further includes a timeout means which is operable to deenergize the pilot valve to interrupt the supply of fuel to the system whenever a pilot flame fails to be established within a predetermined time. The timeout means is prevented from operating as long as a flame is established and sparks are provided by the spark generating means during each sampling interval.

In accordance with the invention, separate control channels are provided for controlling the operation of the spark generating means and the energizing means, thereby substantially eliminating the possibility that a component failure could both prevent spark generation and prevent the operation of the timeout means. For a failure of the spark generating means which causes loss of spark, the system is deactivated by the timeout means. Also, if after a successful start-up a failure occurs which would prevent operation of the timeout means, then for a flameout condition, the spark generating means would be continuously operated until the system is deactivated, as by opening of the thermostatically controlled contacts.

DESCRIPTION OF PREFERRED EMBODIMENTS

General Description

Figure 1:
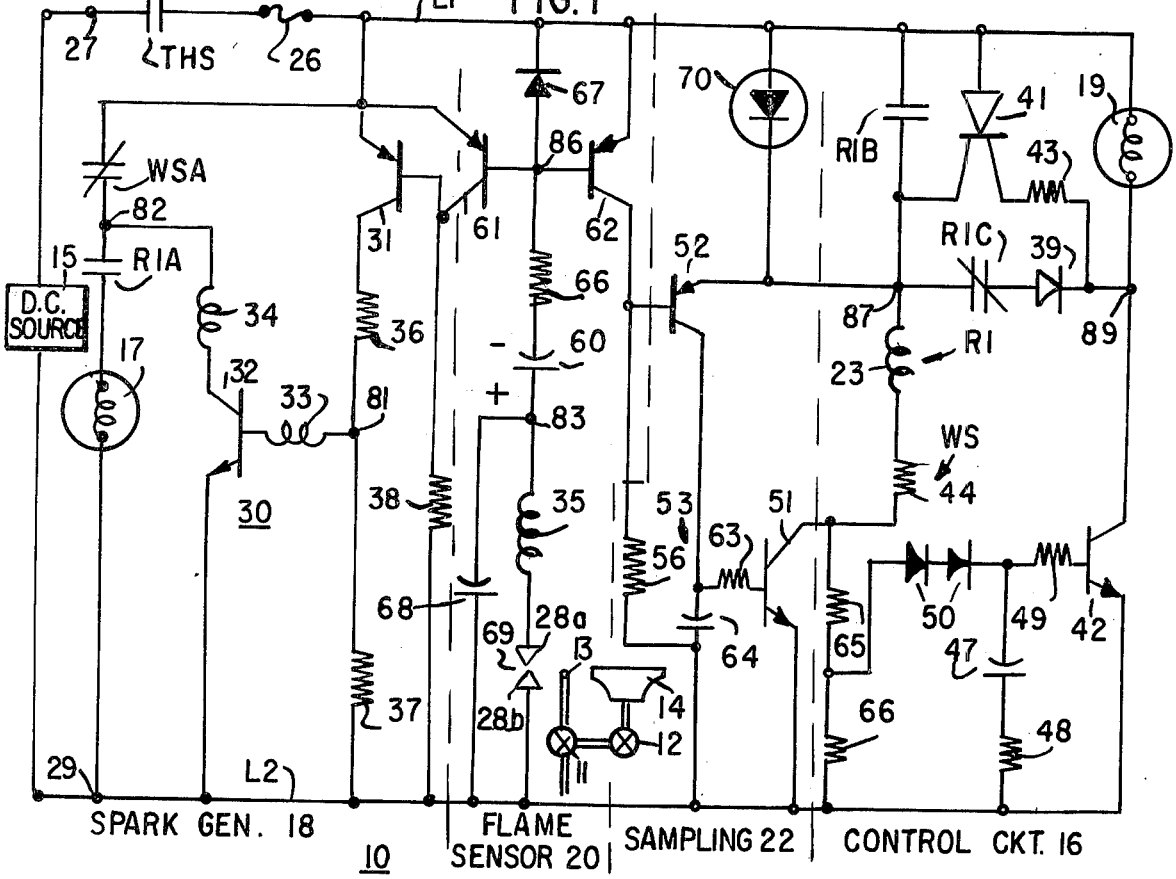
FIG. 1 is a schematic circuit diagram for a self-checking proven-pilot fuel ignition system in accordance with one embodiment of the invention; and, FIG. 2 is a schematic circuit diagram for a self-checking proven-pilot fuel ignition system in accordance with a second embodiment of the invention.

Referring to the drawings, FIG. 1 is a schematic circuit diagram of one embodiment for a self-checking proven-pilot fuel ignition system 10 provided by the present invention. The fuel ignition system 10 may, for example, be used to control heating apparatus for a recreational vehicle, and may be energized from the battery 15 for such vehicle.

The fuel ignition system 10 includes a pilot valve 11 and a main valve 12 which comprise a redundant valve structure in which fuel is supplied to an inlet of the main valve 12 over the pilot valve 11 when the pilot valve 11 is operated. The pilot valve 11 is operable when energized to supply fuel to the main valve inlet and to a pilot outlet 13 for ignition to provide a pilot flame. The pilot flame ignites fuel supplied to a burner 14 when the main valve 12 is operated.

The system 10 further includes a control circuit 16 which operates the pilot valve 11 to supply fuel to the pilot outlet 13, and a spark generating circuit 18 which generates sparks for igniting the pilot fuel. When a pilot flame is established, a flame sensing circuit 20 enables the control circuit 16 to operate the main valve 12. A sampling circuit 22 responds to the flame sensing circuit 20 to cause the fuel valves to remain operated until the heating demand has been met.

The flame sensing circuit 20 also effects periodic enabling of the spark generating circuit 18 when a flame is established to permit testing of the operability of the spark generating circuit 18 during each heating cycle. The control circuit 16 also controls the energization of a timeout device, embodied as a warp switch WS, which is operable to cause 100% shut off of fuel supply to the system 10 in the event the fuel fails to be ignited during a trial for ignition interval following the activation of the system 10 or a flame out condition, or for a loss of flame or spark. Thus, once the fuel valves are energized, continued operation of the valves is dependent upon the presence of a flame and the periodic occurrence of ignition sparks.

The fuel ignition system 10 provides separate circuits for controlling the spark generating circuit 18 and the control circuit 16 to substantially eliminate the possibility that a component failure could both inhibit spark generation and prevent operation of the timeout device WS. Also, the control circuit 16 includes self-checking features which prevent operation of the fuel valves under certain failure conditions as will be shown hereinafter.

Briefly, the spark generating circuit 18 is energized in response to activation of the system 10 by the closing of contacts THS, which may be thermostatically controlled, whereby the battery 15 is connected to the system 10 supplying power to conductors L1 and L2. When energized, the spark generating circuit 18 effects the generation of sparks between a pair of electrodes **28*a* and 28*b*, which are located in the proximity of the pilot outlet 13, for igniting fuel supplied to the pilot outlet 13. The spark generating circuit 18 includes a control transistor 31 which supplies base drive to a transistor 32 which together with windings 33 and 34 of an ignition transformer comprise an oscillator circuit 30 which is operable to produce high voltage pulses for application to the electrodes 28*a* and 28*b*** to produce ignition sparks.

The control circuit 16, which controls the operation of the fuel valves 11 and 12, includes a controlled switching device 41, embodied as a silicon controlled rectifier, and a further pair of switching devices including a relay R1, and a transistor 42. The control circuit 16 also controls the energization of a heater element 44 of the warp switch WS.

The SCR device 41 is enabled in response to the closing of contacts THS to cause the energization of relay R1 and the heater element 44 of the warp switch WS over a low impedance path including a switching device 51, such as a transistor, of the sampling circuit 22. Relay R1 then operates to close contacts R1A to energize the operating coil 17 of the pivot valve 11, to close contacts R1B to provide a holding path for the relay R1, and to open contacts R1C which prevent enabling of the SCR device 41 if for any reason transistor 42 is conducting at start-up Initially, the control circuit 16 is operable in an energizing mode in which the level of energizing current for the warp switch heater 44 is high enough to permit the warp switch WS to operate, after the heating time for the heater element 44, opening contacts WSA for deenergizing the pilot valve 11 if a pilot flame fails to be established within a trial for ignition interval defined by the heating time of the warp switch heater 44.

When a flame is established, transistor 51 is disabled, and the control circuit 16 is placed in a holding mode with relay R1 and the warp switch heater 44 maintained energized over a high impedance holding path including resistors 65 and 66. Such holding path enables current flow at a level that is sufficient to maintain the relay R1 operated, but is insufficient to cause the relay R1 to pull in or to cause the warp switch WS to operate to deenergize the pilot valve 11.

Transistor 42, which controls the energization of the operate winding 19 of the main valve 12, is normally disabled at start-up. When a flame is established at the pilot outlet 13, transistor 42 is enabled in response to the charging of a capacitor 47, which is permitted to charge when transistor 51 of the sampling circuit 22 is rendered non-conductive as the result of operation of the flame sensing circuit 20.

In the event of a flame-out condition following a successful start-up, or for loss of ignition sparks through failure of the spark generating circuit 18 during a heating cycle, the warp switch heater 44 is maintained energized to cause the warp switch WS to operate to deenergize the pilot valve 11 thereby interrupting the supply of fuel to both the pilot outlet 13 and the burner 14.

The sampling circuit 22 responds to the flame sensing circuit 20 to normally maintain the control circuit 16 in the holding mode while a flame is established to prevent the operation of the warp switch WS and for maintaining the valves operated. The sampling circuit 22 periodically places the control circuit 16 in the energizing mode during the time the operability of the spark generating circuit 18 is being tested and to permit deactivation of the system 10 in the event that the spark generating circuit 18 fails to function properly. More specifically, the sampling circuit 22 includes transistor 51 and a further switching device 52, such as a transistor, and an integrating network 53 which controls the transistor 51. The integrating network 53 integrates pulses supplied thereto over transistor 52 from the flame sensing circuit 20 (as the result of the periodic enabling of the spark generating circuit) to normally maintain transistor 51 cutoff, but to permit periodic enabling of the transistor 51. This places the control circuit 16 in the energizing mode for a short time during each sampling interval. The failure of the spark generating circuit 18 to generate pulses, allows transistor 51 to be turned on for a time sufficient to energize the warp switch heater 44 to a level that causes lock out of the system. Also, with transistor 51 turned on, capacitor 47 is permitted to discharge over transistor 42, and the capacitor is prevented from recharging so that the transistor 42 turns off, deenergizing the main valve 12.

For the purpose of controlling the operation of the spark generating circuit 18, as well as the sampling circuit 22, when a flame is established, such that the operability of the spark generating circuit 18 can be tested periodically, the electrodes 28*a* and 28*b* are connected in the flame sensing circuit 20 which senses the flame. The electrodes 28*a* and 28*b* are used both in the ignition of the fuel and in the sensing of the flame. The flame sensing circuit 20 enables the fuel ignition system 10 to operate in a sampling mode in which the spark generating circuit 18 is periodically enabled during sampling intervals defined by the charging time of a capacitor 60 of the flame sensing circuit 20. Also, the control circuit 16 is normally maintained in the holding mode but is placed in the energizing mode during the sampling interval. Capacitor 60, which is alternately charged and discharged during each sampling interval whenever a flame is established, provides a control potential for enabling transistors 61 and 62 of the flame sensing circuit 20. The transistor 61 disables the control transistor 31 of the spark generating circuit 18 during the discharge time of the capacitor 60. Also, transistor 62 disables transistor 52 of the sampling circuit 22 during such time, causing transistor 51 to be held cutoff.

When capacitor 60 becomes discharged, the transistors 61 and 62 are cutoff, permitting the control transistor 31 to become conductive, reenenabling the spark generating circuit and causing transistors 51 and 52 to conduct so that the control circuit 16 is placed in the energizing mode with the warp switch heater energized at its heating level. During such time, the capacitor 60 is also recharged as the result of voltages pulses provided by the spark generating circuit 18, causing transistors 61 and 62 to again be enabled, and the cycle repeats. With the presence of a flame at the electrodes 28*a* and 28*b*, the current flowing through winding 23 and the warp switch heater 44 is only a fraction of that without a flame. Accordingly, heating of the warp switch heater 44 during the small portion of the sampling cycle during which capacitor 60 is charging, is negligible when a flame is established, so that the warp switch contacts WSA remain closed to energize the pilot valve winding 17.

The separate circuits, including transistors 61 and 62, provided to control the operation of the spark generating circuit 18 and the control circuit 16 substantially eliminates the possibility that a component failure could both prevent spark generation and the energization of the warp switch heater 44. For a failure of the spark generating circuit 18, the loss of spark would cause the control circuit 16 to be maintained operating in the energizing mode, allowing the warp switch WS to deenergize the pilot valve 11 thereby providing 100% shut off of fuel to the system 10. Also, following a successful start-up, for any failure that would prevent the warp switch current from reaching its heating level followed by a flame out, the spark generating circuit 18 will be enabled to provide sparks continuously until the contacts THS are opened. For such condition, restart of the system 10 is prevented since the warp switch current must reach its heating level in order for relay R1 to be energized.

The sampling circuit 22 further includes a visual indicating device 70, embodied as a light emitting diode, which permits a loss of spark condition to be indicated. The ignition electrodes 28*a* and 28*b* must be positioned adjacent to the pilot outlet 13 which is generally enclosed and not readily accessible. However, the light emitting diode 70 may be located on the outside of the heating unit which employs the fuel ignition system 10 of the present invention for easy viewing. When the system 10 is operating in the sampling mode, the diode 70 is pulsed on by the sampling circuit 22 each time an ignition spark is generated and as transistor 52 is rendered periodically conductive and non-conductive. In the event of loss of spark, as may occur for a malfunction of the spark generating circuit 18 or a short circuit between the electrodes 28*a* and 28*b*, then transistor 52 of the sampling circuit 22 conducts continuously maintaining the diode on all the time, thereby indicating the loss of spark condition.

Detailed Description

Power is supplied to the fuel ignition system 10 from a DC source 15 which is connectable to a pair of input terminals 27 and 29 of the system 10. Input terminal 27 is connected over thermostatically controlled contacts THS and a fuse 26 to a conductor L1. Terminal 29 is connected directly to a further conductor L2. In the exemplary embodiment, the voltage source 15 is assumed to be a 12 volt battery of a recreational vehicle in which the fuel ignition system 10 is used. When contacts THS are closed, conductor L1 is connected to the positive terminal to the battery 15, conductor L2 being connected over terminal 29 to the negative terminal of the battery.

Referring to the spark generating circuit 18, transistor 31 is connected in an enabling circuit between conductors L1 and L2. The emitter of transistor 31 is connected directly to conductor L1 and the collector of transistor 31 is connected through series connected resistors 36 and 37 to conductor L2. The base of transistor 31 is connected through a resistor 38 to conductor L2. Transistor 31 is normally conducting when contacts THS are closed, supplying base current to transistor 32 of the oscillator circuit 30 over resistor 36 and a feedback winding 33 of the ignition transformer, which is connected between the base of transistor 32 and the junction of resistors 36 and 37 at point 81. The collector of transistor 32 is connected through the primary winding 34 of the ignition transformer to point 82 and over normally closed contacts WSA of the warp switch WS to conductor L1. The emitter of transistor 32 is connected to conductor L2.

The base drive supplied to transistor 32 by transistor 31 enables transistor 32 to begin to conduct permitting current flow through the primary winding 34 of the ignition transformer, providing regenerative feedback to the base of the transistor 32 until saturation is attained. At such time, the primary flux begins to decrease generating a reverse voltage in the feedback winding 33 which tends to cutoff transistor 32 reducing the feedback, permitting transistor 32 to again be driven to saturation and the cycle repeats. The oscillating current in the primary winding 34 generates alternating high voltage pulses in the secondary winding 35 for application to the electrodes 28*a* and 28*b* to produce sparks at the electrodes.

Referring to the flame sensing circuit 20, the high voltage secondary winding 35 of the ignition transformer is connected in a series circuit path with the ignition electrodes 28*a* and 28*b* between conductors L1 and l2. More specifically, one end 83 of secondary winding 35 is connected through capacitor 60, a resistor 66 and a diode 67 to conductor L1. The other end of the secondary winding 35 is connected to electrode 28*a*. The other electrode 28*b* is connected to conductor L2. A capacitor 68 is connected between conductor L2 and the junction of capacitor 60 and end 83 of secondary winding 35. The electrodes 28*a* and 28*b* are spaced apart to provide a gap 69 therebetween to permit the generation of sparks in the gap 69 whenever high voltage pulses are applied to the electrodes 28*a* and 28*b* over the secondary winding 35.

Transistor 61, which controls the disabling of the spark generating circuit 18, has its emitter connected to the emitter of transistor 31 and its collector connected to the base of transistor 31. The base of transistor 61 is connected to the junction of the anode of diode 67 and resistor 66, at point 86, to enable transistor 61 to be enabled when capacitor 60 discharges. When transistor 61 is enabled, the transistor 61 effectively shorts the base to emitter circuit of transistor 31, interrupting the supply of base current to transistor 32 thereby inhibiting spark generation by cutting off oscillator transistor 32 while a flame is established. When transistor 61 is thereafter disabled, the control transistor 31 is again enabled and supplies base drive to transistor 32, initiating further oscillations and further spark generation. In the normal operating mode, the spark generating circuit 18 is enabled for a fraction of a second every eight to ten seconds while a flame is established.

During the time that the spark generating circuit 18 is enabled, the capacitor 60 is charged and then discharges causing transistors 61 and 62 to be enabled during the eight to ten interval between sparks. Transistor 62, which controls the sampling circuit 22, has its emitter connected to conductor L1 and its collector connected to the base of transistor 52 of the sampling circuit 22 and over a reisistor 56 to conductor L2. The base of transistor 62 is connected to point 86.

With reference to the sampling circuit 22, the emitter of transistor 52 is connected to point 87 which is connected to conductor L1 over contacts R1B of relay R1 whenever the relay is operated. The light emitting diode 70 is connected between conductor L1 and the emitter of transistor 52 and glows when contacts THS are closed and contacts R1B are open. The collector of transistor 52 is connected over capacitor 64 to conductor L2. Capacitor 64 is charged whenever transistor 52 is conducting to provide a potential at the base of transistor 51 to maintain transistor 51 conducting for a time after transistor 52 is rendered non-conducting.

Transistor 51 has its collector-emitter circuit connected in shunt with resistors 65 and 66 to provide a low impedance energizing path for the operate winding 23 of relay R1 and the heater element 44 of the warp switch WS when transistor 51 is conducting. On start-up, transistors 51 and 52 are conducting with transistor 51 providing a low impedance energizing path for relay R1 and warp switch WS. Once ignition has occurred, transistors 51 and 52 are normally maintained nonconducting, that is during the eight to ten second discharge time for capacitor 60, and while transistor 62 is conducting. While the capacitor 60 is charging, and with transistor 62 cut off, transistors 51 and 52 are conducting so that resistors 65 and 66 are bypassed and heating level current is supplied to warp switch heater 44 for the short time that capacitor 60 is charging, typically less than a second.

Considering the control circuit 16, the SCR device 41 has its anode-cathode circuit connected in a series energizing path with the operate winding 23 of relay R1, the heater element 44 of the warp switch WS and resistors 65 and 66 (assuming transistor 51 is disabled) between conductors L1 and L2. The values of resistors 65 and 66 are selected such that the current over the holding path, including resistors 65 and 66 is in the order of one-sixth of the energizing current which flows when transistor 51 is enabled, so that relay R1 cannot pull in over the holding path, and the current is below the level of heating current needed to operate the warp switch. Whenever transistor 51 is conducting and the SCR device 41 is enabled, the relay R1 is operated and heating level current is supplied to the warp switch heater 44.

When relay R1 operates, contacts R1A and R1B are closed and contacts R1C are opened. Contacts R1A are connected in an energizing path for the pilot valve solenoid 17 with normally closed contacts WSA of the warp switch between conductors L1 and L2 so that the pilot valve is operated when relay R1 operates. p Contacts R1B are connected in shunt with the anode-cathode circuit of the SCR device 41, turning off the SCR device 41, and providing a holding path for relay R1 when contacts R1B close. Contacts R1C are connected in series with a diode 39 between the cathode of the SCR device 41 and point 89 which is connected to the collector of transistor 42. Contacts R1B and diode 39 provide a path to blow fuse 26 if transistor 42 is conducting at start-up and SCR 41 is shorted from anode to cathode.

The emitter of transistor 42, which is maintained nonconducting at start-up, is connected to conductor L2. Thus, if for any reason transistor 42 is conducting at start-up, the gate of the SCR device 41 is effectively connected to conductor L2 preventing enabling of the SCR device 41 thereby preventing the operation of relay R1. Thus, the SCR device 41 effectively monitors transistor 42 and if it is shorted, prevents energization of relay R1.

Base drive for transistor 42 is provided by voltage divider formed by resistors 65 and 66, the junction of which is connected over temperature compensation diodes 50 and resistor 49 to the base of transistor 42. Capacitor 47 is connected to the junction of resistor 49 and diodes 50 and to conductor L2 so that capacitor 47 is charged by current flow over a circuit path including relay R1, warp switch heater 44, resistor 65, diodes 50, capacitor 47 and a resistor 48, when transistor 51 is cutoff. Capacitor 47 and resistor 49 form a delay circuit for maintaining transistor 42 conductive for a time, typically in the order of two seconds, when transistor 51 is conducting, so that the main valve 12 is maintained operated. Stated in another way, should transistor 51 be maintained conducting for a period longer than 2 seconds, capacitor 47 becomes discharged to allow transistor 42 to be cut off, thereby deenergizing the main valve solenoid 19. In normal operation, transistor 51 conducts for less than one second during each sampling interval while capacitor 47 is charged during the eight to ten second holding interval so that normally, once transistor 42 is enabled after a successful start-up, transistor 42 is maintained conducting until the heating demand is met.

Operation

When contacts THS are open, the system 10 is deactivated with fuel valves 11 and 12 and relay R1 deenergized. Also, warp switch contacts WSA are closed. When contacts TS close in response to a call for heat, the 12 volt potential of battery 15 is applied to conductors L1 and L2.

Accordingly, with reference to the spark generating circuit 18, when conductors L1 and L2 are activated, current flows from conductor L1 over the emitter-collector circuit of transistor 31 and thence over voltage dividing resistors 36 and 37 to conductor L2. Current also flows over winding 33 and the base-emitter circuit of transistor 32 to conductor L2. Moreover, current flows over warp switch contacts WSA and through the primary winding 34 of the ignition transformer and the collector-emitter circuit of transistor 32 to the conductor L2. The flux generated as the result of such current flows induces a voltage in the feedback winding 33 resulting in an increase in the conduction of transistor 32 with an attendant increase in collector current, and thus the feedback voltage, until the transistor 32 is driven into saturation.

When transistor 32 is saturated, a feedback voltage is no longer induced in the feedback winding 33 and the primary flux in winding 34 begins to decrease causing a reverse voltage to be generated in the feedback winding 33 which tends to cut off transistor 32. This in turn reduces the feedback, and thus, base current for transistor 32 starts to flow again to repeat the cycle. The net effect is an oscillating current in primary winding 34 which generates alternating high voltage pulses, in the order of 10KV, in the secondary winding 35. Each voltage pulse thus produced, causes a spark to jump from electrode **28*a* to electrode 28*b*** and conductor L2.

Referring to the control circuit 16, current also flows through the main valve solenoid 19, through resistor 43, the gate to cathode circuit of the SCR device 41, the operate winding 23 of relay R1, the heater element 44 of the warp switch WS and resistors 65 and 66 to conductor L2. This current, which is gate current for the SCR device 41, is in the order of microamps but is sufficient to cause the SCR device 41 to conduct. Accordingly, current now flows from conductor L1 over the anode-cathode circuit of the SCR device 41, relay winding 23, heater element 44, the collector-emitter circuit of the transistor 51, which is now conducting, to conductor L2, energizing the relay coil 23 causing the relay R1 to operate. It is pointed out that transistor 51 is conducting because current flows from point 87 through the emitter-base circuit of transistor 52 and through resistor 56 to conductor L2. This causes current to flow from emitter to collector of the transistor 52 to resistor 63 and into the base of the transistor 51.

When relay R1 operates, contacts R1A close to energize the pilot valve solenoid 17 so that the pilot valve operates, supplying fuel to the pilot outlet for ignition by the sparks being provided by the spark generating circuit 18 which is also enabled at this time. Also, contacts R1B close to provide a holding path for the relay R1, and contacts R1C open interrupting the shunt path between points 87 and 89. Also, as long as transistor 51 is maintained conducting, heating current is being supplied to the warp switch heater element.

When the pilot fuel is ignited and the flame bridges the gap 69 between the ignition electrodes **28*a* and 28*b*, the rectification properties of the flame charge capacitor 60 so that point 83 becomes positive relative to conductor L1, permitting capacitor 60 to discharge enabling transistors 61 and 62 to to disable the spark generating circuit 18 and to effect the operation of the main valve 12** in the following manner.

When point 83 becomes more positive than conductor L1, current flows from one side of the capacitor 60 at point 83 through the secondary winding 35, the electrodes **28*a* and 28*b* and the flame to conductor L2, and thence through the battery 15 to conductor L1, the emitter-base circuit of transistor 61 to the other side of the capacitor 60. This causes current to flow from the emitter to collector of transistor 61 and resistor 38 to conductor L2. Conduction of transistor 61 shorts the base-collector of transistor 31 which stops conducting and cuts off the supply of base current to transistor 32 of the oscillator circuit 30** to stop the generation of pulses.

Similarly, transistor 62 is caused to conduct, to short the emitter to base of transistor 52 to remove the base drive from transistor 51 which then turns off. Accordingly, the resistors 65 and 66 are connected into the holding path for the relay R1 and the warp switch heater element 44. Also a charging path is provided for the capacitor 47 which charges and thereby enables transistor 42 to energize the main valve solenoid 19 causing the main valve 12 to operate to supply fuel to the burner 14 for ignition by the pilot flame.

Capacitor 60 discharges for approximately ten seconds, and after such time, transistors 61 and 62 are disabled. This causes transistor 31 to be enabled to supply power to the oscillator circuit 30 causing the generation of further sparks, such sparks causing capacitor 60 to be recharged and after a short time, typically a fraction of a second, the capacitor 60 is charged and begins to discharge, reenabling transistors 61 and 62.

During the short spark interval, transistor 52 is enabled to supply base drive to transistor 51 which turns on, removing base drive from transistor 42 which is maintained conducting by the charge on capacitor 47, which in the disclosed embodiment, is assumed to maintain the transistor 42 conducting for 2 seconds after transistor 51 is enabled. When transistor 62 is reenenabled, transistors 51 and 52 are cut off and capacitor 47 is charged by current flowing over the holding path, including winding 23, heater element 44, and resistor 65 and supplied to the capacitor 47 over diodes 50. The cycle then repeats with a spark being provided at the electrodes **28*a* and 28*b*** for a fraction of a second, every eight to ten seconds.

If the pilot flame is extinguished, the discharge path for capacitor 60 is interrupted and transistors 61 and 62 are disabled, permitting the spark generating circuit 18 to be enabled instantly, and causing the sampling circuit 22 to effect the energization of the warp switch heater 44 at its heating level, and to remove base drive from transistor 42. If a pilot flame is not reestablished within 2 seconds, the main valve 12 drops out when transistor 42 is cut off. Also, if the flame is not reestablished prior to heating time of the warp switch heater 44, typically fifteen seconds, the warp switch WS operates to deenergize the pilot valve 11 and the spark generating circuit 18, effecting 100% shut off.

Safety Aspects

As indicated above, separate control circuits are provided for controlling the spark generating circuit 18 and the energizing circuit, including the sampling circuit 22 and the control circuit 16, which operates the valves 11 and 12. This substantially eliminates the possibility that a component failure could both prevent the warp switch heater current from increasing to the required heating level, and cause the spark generating circuit 18 to be disabled, an unsafe condition. The dual channel control afforded by the system 10 of the present invention responds to a failure, occuring after a successful start up, that would prevent the warp switch current from reaching its required heating level in the event of a flame out, to cause the spark generating circuit 18 to be enabled continuously until reignition occurs or until contacts THS are opened. The system 10 does not restart when contacts THS are thereafter reclosed because the warp switch current, which flows in the energizing path for the relay operate winding 23, will not reach its heating level thereby preventing the operation of the relay R1.

The system 10 includes an interlock arrangement in which the SCR device 41 monitors the transistor 42 and prevents start-up if for any reason transistor 42 is conducting at the time contacts THS close to activate the system. If transistor 42 is conducting following the closing of contacts THS, the SCR device 41 remains in a non-conductive state since the gate of the SCR device 41 is effectively grounded to the conductor L2 over the collector-emitter circuit of the transistor 42. Therefore, in order for the system 10 to start, transistor 42 must be non-conducting at the time the SCR device 41 is enabled.

Also, if the SCR device 41 becomes shorted, and a subsequent failure occurs to short transistor 42, then when contacts THS close, a direct short to ground is provided over the SCR device 41, contacts R1C, diode 39 and the collector-emitter of transistor 42, causing fuse 26 to open circuit conductor L1 to shut the system down.

The system 10 also provides a check for the operability of the sampling circuit 22 on start up. As noted above, the spark generating circuit 18 is energized directly when the contacts THS close in response to a call for heat. Capacitor 64 integrates the high frequency output of the oscillator circuit 30, and maintains a DC level at the base of transistor 51, maintaining transistor 51 in saturation during the trial for ignition interval. As a result, transistor 42 is cut off since its base drive is removed. Thus, the main valve 12 is deenergized. For an open circuit condition for capacitor 64 which prevents the enabling of transistor 51 during the trial for ignition interval, base drive is supplied to transistor 42, causing the transistor 42 to conduct and the SCR device 41 is locked out, preventing the operation of relay R1 so that the pilot valve 11 remains closed. Thus, although the main valve 12 is energized, no fuel flows because the pilot valve 11 is closed, and the system becomes locked out under the control of the warp switch WS. Therefore, an open capacitor 64 or any fault that may result in an unsafe failure, will lock out the system 10 at start up.

It should be noted that if the spark generating circuit 18 is not operating, transistor 51 is maintained enabled and transistor 42 is maintained cutoff, and the warp switch WS will lock out the system.

When contacts THS are open, or for a line voltage interruption, the circuit components of the system 10 are in a non-conducting state and remain non-conducting in case of a fault. Thus, a line voltage interruption under a failure condition will keep the system locked out.

Second Embodiment

Figure 2:
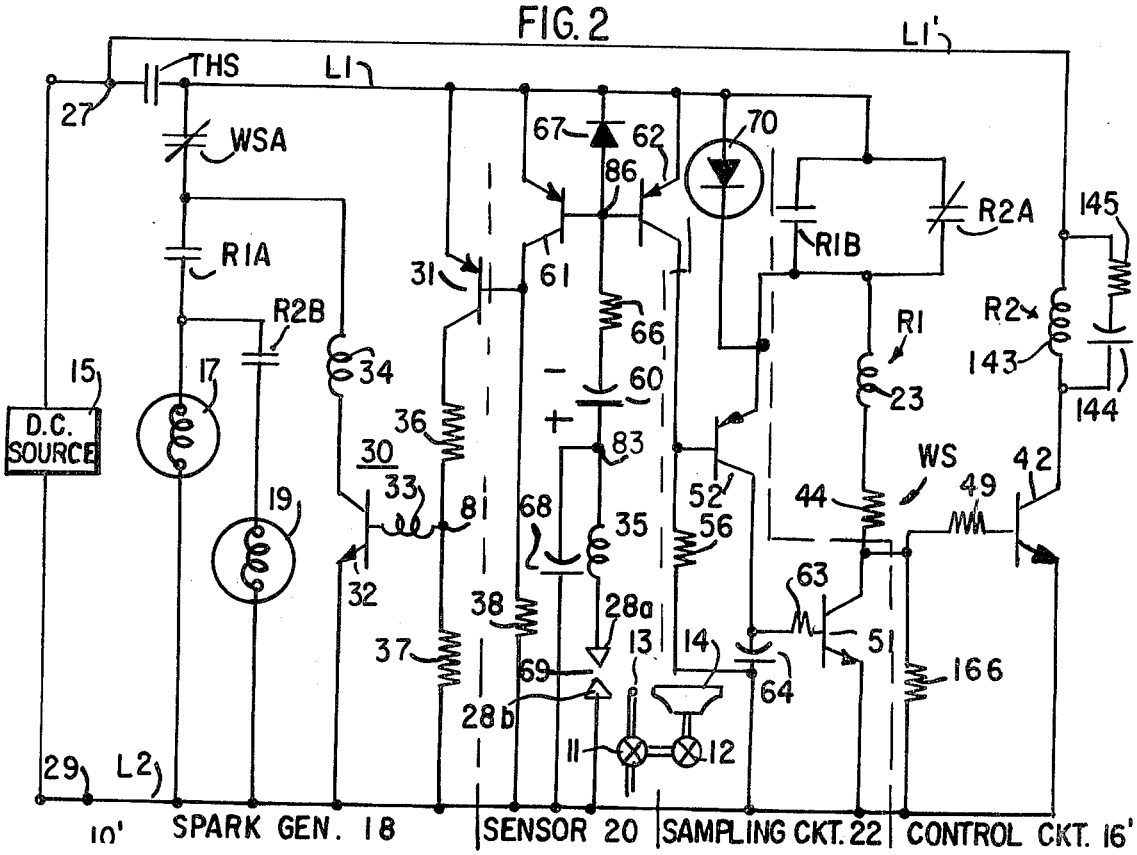

Referring to FIG. 2, there is shown a schematic circuit diagram of a second embodiment for a self-checking proven-pilot fuel ignition system 10′ provided by the present invention. The system 10′ is generally similar to the system 10 shown in FIG. 1, and accordingly, like elements have been given the same reference numerals.

The system 10′ includes redundant pilot and main valves 11 and 12, a spark generating circuit 18, and a flame sensing circuit 20 which are the same as similarly referenced elements of the embodiment shown in FIG. 1. The system 10′ also includes a sampling circuit 22 which is the same as circuit 22 of FIG. 1, and a control circuit 16′.

In the system 10′, the control circuit 16′ affords interlock protection through the use of a relay R2, which is energized in response to the enabling of transistor 42. Relay R2 has normally closed contacts R2A connected in the energizing path for the operate winding 23 of relay R1 and the heater element 44 of the warp switch WS. Thus, relay R1 is prevented from operating in response to the closing of contacts THS if for any reason contacts R2A of relay R2 are open.

Considering the control circuit 16′ in more detail, the operate winding 23 and the heater element 44 of the warp switch WS are connected in series with contacts R2A of relay R2 and a resistor 166 between conductors L1 and L2. As in the embodiment shown in FIG. 1, the relay R1 and warp switch heater 44 are energized when transistor 51 is conducting, transistor 51 having its collector-emitter circuit connected in shunt with the resistor 166.

Relay R1 has normally open contacts R1A connected in the energizing path for the pivot valve solenoid 17, and normally open contacts R1B connected in shunt with contacts R2A or relay R2 to provide a shunt path around contacts R2A when relay R2 is operated.

Relay R2 has an operate winding 143 having one end connected over a conductor L1′ to terminal 27 of the system 10′, and its other end connected to the collector of transistor 42. The transistor 42 has its emitter connected to conductor L2 to complete an energizing path for the relay R2 when the transistor 42 is conducting. A capacitor 144 and a resistor 145 are connected in parallel with the winding 143 to make the relay R2 slow to release.

Relay R2 controls the energizing of the main valve solenoid 19 over contacts R2B which are operable to connect the solenoid 19 in an energizing path which extends from conductor L1 over contacts R1A or relay R1, contacts R2B, the solenoid 19 to conductor L2.

Transistor 42 has its base connected over a resistor 49 to the junction of resistor 166 and the warp switch heater element 44, and over resistor 166 to conductor L2. Transistor 42 is enabled whenever transistor 51 is disabled following the ignition of the pilot fuel, effecting the operation of relay R2 to cause the main valve 12 to operate.

Operation

In operation, when contacts THS close in response to a request for heat, the spark generating circuit 18 is energized and operates as described above to generate sparks. Also, the operate winding 23 of relay R1 and the warp switch heater 44 are energized over contacts R2A and transistor 51, which is conducting at this time. Transistor 51 is conducting because when contacts THS close, transistor 52 is enabled in response to current flow over the emitter-base circuit of the transistor, so that base current is supplied to transistor 51.

Accordingly, relay R1 operates, closing contacts R1A to energize the pilot valve 11 supplying fuel to the pilot outlet 13 for ignition by the sparks provided by the spark generating circuit 18. Also, contacts R1B close to provide a shunt path around contacts R2A.

When the pilot fuel is ignited, the flame sensing circuit 20 operates in the manner described above with the transistors 61 and 62 being enabled to disable the spark generating circuit 18 and transistors 51 and 52 of the sampling circuit 22. When transistor 51 is cut off, transistor 42 is enabled in response to current flow over the voltage divider formed by relay winding 23, heater element 44 and resistor 166 effecting the operation of relay R2. Relay R2 operates to open contacts R2A and to close contacts R2B to energize the main valve 12 to supply fuel to the burner apparatus 14 for ignition by the pilot flame.

The operation of the flame sensing circuit 20 is the same as described above with reference to FIG. 1 with capacitor 60 charging and discharging through the flame at approximately ten second intervals. During the charging time transistors 61 and 62 are cutoff and thus the spark generating circuit 18 and the transistors 51 and 52 are enabled. Thus, during such time, a spark appears at the electrodes 28*a* and 28*b* for a fraction of a second. Also, since transistor 51 is enabled, the warp switch heater current is at the heating level during the short time that the capacitor 60 is charged. Further, transistor 42 is non-conducting, with relay R2 being maintained operated by capacitor 144 which supplies holding current for the relay R2 during the spark interval.

Therefore, as long as a flame remains established, relays R1 and R2 are energized, and pulsed current supplied to the warp switch heater 44 enables the heater element 44 to remain cool. The voltage excursion is typically in the order of 1 volt for 10 seconds and approximately 7 volts for the fraction of a second that capacitor 60 is charging.

If the pilot flame is extinguished, the discharge path for capacitor 60 is interrupted and thus transistors 61 and 62 are cutoff, so that the spark generating circuit 18 and the transistors 51 and 52 are enabled. Instantly, the warp switch heater current jumps to the heating level and the spark generating circuit 18 produces sparks at the electrodes 28*a* and 28*b*. If a flame fails to be reestablished within approximately 2 seconds, relay R2 drops out, causing deenergization of the main valve 12. Also, if the flame is not reestablished within the heating time of the warp switch heater element 44, typically 15 seconds, the warp switch WS operates to open contacts WSA, shutting off the fuel and deactivating the spark generating circuit 18.

Safety Aspects

The system 10' provides separate control channel for controlling the spark generating circuit 18 and the energizing circuit, including the sampling circuit 22 and the control circuit 16, which controls the operation of the fuel valves 11 and 12. The advantages of this arrangement have been set forth in detail in the foregoing description with reference to the system 10 shown in FIG. 1.

As indicated above, relays R1 and R2 provide an interlock function to prevent fuel from being supplied to the burner apparatus under certain failure conditions. Relay contacts R2A must be closed in order to start the system 10'. If transistor 42 is conducting for any reason, relay R2 will be energized and contacts R2A will be open preventing the energization of the relay R1 when contacts THS close, and the system 10' will be locked out. Relay R2 is energized over conductor L1' which is connected to terminal 27, ahead of contacts THS, to prevent a timing race between relays R1 and R2 following the closing of contacts THS to activate the system 10'.

I claim:

1. In a fuel ignition system including valve means operable when energized to supply fuel to a burner apparatus, an ignition control for controlling the operation of said valve means and for ignition fuel discharged by said burner apparatus, said ignition control comprising activate means for generating an activate signal, spark generating means responsive to said activate signal to generate sparks in the proximity of said burner apparatus, energizing means including control means and timeout means, said control means being responsive to said activate signal to control said valve means to supply fuel to said burner apparatus for ignition by said sparks to establish a flame, and to enable said timeout means to be operable to cause said valve means to interrupt the supply of fuel to said burner apparatus whenever a flame fails to be established within a predetermined interval of time, and flame sensing means including first and second inhibit means and timing means operable when a flame is established within said time interval to control said first and second inhibit means to cause said fuel ignition system to be operable in a sampling mode in which said first inhibit means responds to said timing means to disable said spark generating means during a first period of time and to enable said spark generating means to generate sparks during a second period of time, and said second inhibit means responds to said timing means to prevent said timeout means from operating and in which said second inhibit means responds to said timing means to enable said timeout means to cause said valve means to interrupt the supply of fuel to said burner apparatus in the event that said spark generating means fails to provide sparks during said second period of time.

2. A system as set forth in claim 1 wherein said control means comprises switching means for effecting the energization of said valve means tentatively, said timeout means causing the deenergization of said valve means when a flame fails to be established within said predetermined interval.

3. A system as set forth in claim 2 wherein said energizing means further includes sampling means responsive to said activate signal to permit said switching means to effect the energization of said valve means, said sampling means responding to said second inhibit means when a flame is established to override said timeout means and to cause said control means to maintain said valve means in fuel supplying condition.

4. A system as set forth in claim 3 wherein said sampling means includes indicator means which provides a first indication each time a spark is generated, and provides a second indication whenever said spark generating means fails to provide a spark during said second period of time.

5. A system as set forth in claim 3 wherein said control means includes circuit means for connecting said timeout means in a first circuit path for energizing said timeout means at a first current level, said sampling means including further switching means operable when enabled to complete a second circuit path for energizing said timeout means at a second current level, said timeout means being operable to deenergize said valve means whenever said timeout means is energized by current at said second level for said predetermined time interval.

6. A system as set forth in claim 5 wherein said first inhibit means for disabling said spark generating means for said first period of time, and said second inhibit means disables said further switching means for said first period of time to permit said timeout means to be energized at said first level, and enables said further switching means during said second period of time to permit said timeout means to be energized by current at said second level, said further switching means being maintained enabled after said second period of time to permit said timeout means to deenergize said valve means whenever said spark generating means fails to provide sparks during said second period of time.

7. A system as set forth in claim 5 wherein said first-mentioned switching means is energized over said second circuit path, and is maintained energized over said first circuit path whenever said further switching means is disabled.

8. In a fuel ignition system including valve means having a pilot valve operable when energized to supply fuel to a burner apparatus for ignition to provide a pilot flame, and a main valve operable when energized to supply fuel to said burner apparatus for ignition by the pilot flame, an ignition control for controlling the operation of said valve means comprising activate means for generating an activate signal, spark generating means responsive to said activate signal to generate sparks for igniting fuel discharged by said burner apparatus to establish a pilot flame, energizing means including control means responsive to said activate signal to energize said pilot valve, and flame sensing means including first and second inhibit means and timing means operable when a flame is established to generate a periodically recurring timing signal, said first inhibit means responding to said timing signal to cause said control means to effect the operation of said main valve and to maintain said pilot and main valves operated as long as said timing means generates its timing signal, and said second inhibit means responding to said timing signal to disable said spark generating means for a first period of time to thereby inhibit the generation of sparks and to thereafter enable said spark generating means for a second period of time to permit the generation of further sparks, said timing means being prevented from generating its timing signal whenever said spark generating means fails to provide sparks during said second period of time.

9. A system as set forth in claim 8 wherein said pilot valve and said main valve comprise a redundant valve structure in which fuel is supplied to said main valve over said pilot valve only when said pilot valve is operated.

10. A system as set forth in claim 9 wherein said energizing means includes timeout means operable to effect the deenergization of said pilot valve and said spark generating means, thereby interrupting the supply of fuel to said burner apparatus and preventing further activation of said spark generating means in the absence of a flame or sparks for a predetermined interval of time.

11. A system as set forth in claim 9 wherein said energizing means includes first switching means operable when enabled to complete an energizing path for said pilot valve, and second switching means operable when enabled to complete an energizing path for said main valve, said first switching means being prevented from operating whenever the energizing path for said main valve is completed at the time that said first switching means is enabled.

12. A system as set forth in claim 11 wherein said energizing means further includes sampling means for preventing the operation of said second switching means in the absence of a flame, said sampling means being controlled by said first inhibit means to effect the enabling of said second switching means when a pilot flame is established.

13. In a fuel ignition system including valve means operable when energized to supply fuel to a burner apparatus, an ignition control for controlling the operation of said valve means and for igniting fuel discharged by said burner apparatus, comprising activate means for generating an activate signal, spark generating means responsive to said activate signal to generate sparks in the proximity of said burner apparatus, energizing means including control means and sampling means for enabling said control means to respond to said activate signal to control said valve means to supply fuel to said burner apparatus for ignition by said sparks to establish a flame, timeout means energized by said control means to be operable to cause said valve means to interrupt the supply of fuel to said burner apparatus whenever a flame fails to be established within a predetermined time interval, and flame sensing means including timing means operable when a flame is established within said predetermined time interval to generate a periodically recurring timing signal, said flame sensing means further including first inhibit means responsive to said timing signal for causing said spark generating means to be disabled during a first period of time and enabled to generate sparks during a second period of time, and second inhibit means responsive to said timing signal to periodically inhibit said sampling means to thereby prevent said timeout means from operating, said timing means being prevented from generating its timing signal whenever said spark generating means fails to provide sparks during said second period of time whereby said sampling means allows said timeout means to operate causing said valve means to interrupt the supply of fuel to said burner apparatus.

14. A system as set forth in claim 13 wherein said valve means comprises a pilot valve operable when energized to supply fuel to said burner apparatus for ignition by said ignition sparks to provide a pilot flame, and a main valve operable when energized to supply fuel to said burner apparatus for ignition by said pilot flame, said control means including first switching means responsive to said activate signal for energizing said pilot valve, and second switching means responsive to said sampling means for energizing said main valve when a pilot flame is established.

15. A system as set forth in claim 14 wherein said sampling means includes third switching means responsive to said activate signal to be enabled in the absence of a flame to provide an energizing path for said first switching means and to prevent enabling of said second switching means, said third switching means being disabled by said second inhibit means for said first period of time after a flame is established to permit said second switching means to effect the energization of said main valve.

16. A system as set forth in claim 15 wherein said timeout means comprises a warp switch having a heater element connected in said energizing path for said first switching means, and having normally closed contacts connected in an energizing path for said pilot valve.

17. A system as set forth in claim 15 wherein said first switching means includes a relay having an operate winding connected in said energizing path and a controlled switching device enabled by said activate signal to complete said energizing path, said second switching means including a normally disabled switching device which is operable when enabled to connect said main valve to a source of energizing potential.

18. A system as set forth in claim 15 wherein said first switching means comprises a first relay having an operate winding connected in said energizing path, said second switching means comprising a second relay having first normally closed contacts connected in said energizing path to permit the energization of said first relay only when said second relay is deenergized, said first relay having normally open contacts connected in shunt with said first contacts to provide a holding path for said first relay when said second relay subsequently operates.

* * * * *

UNITED STATES PATENT AND TRADEMARK OFFICE

CERTIFICATE OF CORRECTION

PATENT NO. : 4,111,639

DATED : September 5, 1978

INVENTOR(S) : Russell Byron Matthews

It is certified that error appears in the above-identified patent and that said Letters Patent are hereby corrected as shown below:

Column 15, line 22, cancel "for disabling" and substitute -- disables.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*